US007743826B2

(12) United States Patent
Harris et al.

(10) Patent No.: US 7,743,826 B2
(45) Date of Patent: Jun. 29, 2010

(54) IN SITU METHOD AND SYSTEM FOR EXTRACTION OF OIL FROM SHALE

(75) Inventors: Harry Gordon Harris, Laramie, WY (US); Paul Lerwick, Midland, TX (US); R. Glenn Vawter, Glenwood Springs, CO (US)

(73) Assignee: American Shale Oil, LLC, Newark, NJ (US)

( * ) Notice: Subject to any disclaimer, the term of this patent is extended or adjusted under 35 U.S.C. 154(b) by 452 days.

(21) Appl. No.: 11/655,152

(22) Filed: Jan. 19, 2007

(65) Prior Publication Data

US 2007/0193743 A1 Aug. 23, 2007

Related U.S. Application Data

(60) Provisional application No. 60/760,698, filed on Jan. 20, 2006.

(51) Int. Cl.
*E21B 43/24* (2006.01)

(52) U.S. Cl. ..... 166/245; 166/57; 166/58; 166/59; 166/60; 166/61; 166/62; 166/248; 166/307; 208/390

(58) Field of Classification Search ..... 208/390; 166/57–62, 248, 307, 245
See application file for complete search history.

(56) References Cited

U.S. PATENT DOCUMENTS 5,816,325 A 10/1998 Hytken
6,712,136 B2 3/2004 de Rouffignac et al.
6,896,053 B2 5/2005 Berchenko et al.
6,997,518 B2 2/2006 Vinegar et al.
2002/0074122 A1* 6/2002 Kelley et al. ..... 166/313
2007/0045266 A1* 3/2007 Sandberg et al. ..... 219/207

OTHER PUBLICATIONS

Garrouch, A.A. et al (2004). Journal of Petroleum Science and Engineering, 44, 283-301.*
Hytken, Kent B., Facsimile Transmittal Sheet to Glenn Caldarola at the US Patent Office dated Jun. 17, 2009.

* cited by examiner

*Primary Examiner*—Glenn A Caldarola
*Assistant Examiner*—Brian McCaig
(74) *Attorney, Agent, or Firm*—Holland & Hart LLP

(57) ABSTRACT

A system and process is disclosed for retorting oil shale and extracting shale oil and other hydrocarbons therefrom, in which a cased heat delivery well is drilled generally vertically through an overburden and then through a body of oil shale to be retorted to the bottom thereof, generally horizontally under the body of oil shale to be retorted, and then back to the earth surface. Heat energy is transmitted conductively to the body of oil shale to be retorted from a closed loop heat delivery module in the well, the module comprising a fluid transmission pipe containing a heating fluid heated to at least a retorting temperature. Heat energy is also transmitted to the body of oil shale to be retorted above the fluid transmission pipe by vapor conduits that conduct retort vapors upward through the body of oil shale to be retorted; the ascending retort vapors condense and reflux, delivering their latent heat of vaporization to the body of oil shale to be retorted, and the condensed retort liquids descend. If not recycled, the retort liquids are collected in a sump at the bottom of a production well and are transmitted to the surface for processing. The vapor conduits communicate at upper ends thereof with the production well, so that vapors that do not reflux are collected in the production well and are transmitted to the surface for processing.

6 Claims, 4 Drawing Sheets

IN SITU METHOD AND SYSTEM FOR EXTRACTION OF OIL FROM SHALE

PRIORITY CLAIM

This application claims priority to Provisional Patent Application No. 60/760,698, entitled "EGL Oil Shale Process—An in-situ, thermal recovery process (ISTRP) utilizing a closed loop, largely self-sustaining, heating system and directionally drilled clusters of small, open wellbores designed to facilitate heat transfer and collection of thermally generated oil and natural gas," mailed on Jan. 20, 2006, which application is incorporated herein by reference.

BACKGROUND

The present invention relates generally to processes and apparatus for in situ extraction or production of hydrocarbons—including oil and gas—from underground oil shale formations. In particular, the present invention concerns a method and system in which an energy source, preferably oil shale or hydrocarbons derived therefrom, is used to heat a closed system, thereby lessening adverse environmental impacts, the closed system providing the heat to retort the oil shale.

Oil Shale

Oil shale is a general term applied to a group of rocks rich enough in organic material (called kerogen) to yield petroleum upon distillation. The kerogen in oil shale can be converted to oil through the chemical process of pyrolysis. During pyrolysis the oil shale is heated in the absence of air, a process called retorting, which converts the kerogen to oil. Oil shale has also been burned directly as a low-grade fuel. The United States Energy Information Administration estimates the world supply of oil shale at 2.6 trillion barrels of recoverable oil, 1.0-1.2 trillion barrels of which are in the United States.

Oil shale is considered to be formed by the deposition of organic matter in lakes, lagoons and restricted estuarine areas such as oxbow lakes and muskegs. Generally, oil shales are considered to be formed by accumulation of algal debris. When plants die in these peat swamp environments, their biomass is deposited in anaerobic aquatic environments where the low oxygen levels prevent their complete decay by bacteria. For masses of undecayed organic matter to be preserved and to form oil shale the environment must remain steady for prolonged periods of time to build up sufficiently thick sequences of algal matter.

There are two main methods of extracting oil from shale ("oil shale extraction processes")—mining and in-situ. With mining, which is the traditional or conventional oil shale extraction process, the oil shale is mined either by underground or surface mining and then is transported to a processing facility for retorting. At the processing facility, the shale is heated to a "retorting temperature"—for surface retorting during a relatively short interval of no more than a few hours, 445-500° C. (842-932° F.). The resulting oil is then separated from the waste material. With in-situ processing, the shale is heated underground to release gases and oils.

Historically, oil shale has been mined, crushed, and roasted in large kilns (called retorts). The slag, swollen in volume and contaminated with arsenic and other contaminants, must then be disposed of. The mining process for oil extraction from oil shale is so costly, laborious, and polluting that global output has never exceeded 25,000 barrels a day, compared to 84 million barrels of conventional oil production. The environmental problems associated with the mining process are severe, particularly in regard to disposal of waste residues and the consumption of water.

The historic oil shale extraction process is also not competitive with other fossil fuels. The U.S. Department of Energy (DOE) estimates that initial costs of production of oil extracted from oil shale by the traditional method would be $70 to $95 per barrel of oil, and long term prices would be $30 to $40 per barrel of oil. See "High-Temperature Reactors for In Situ Recovery of Oil from Oil Shale," Charles W. Forsberg, Oak Ridge National Laboratory, U.S. Dept. of Energy, Address delivered at 2006 International Congress on Advances in Nuclear Power Plants, Jun. 7, 2006, Reno, Nev. (Current oil prices are approximately $60 per barrel.) The DOE estimates that a Shell oil shale extraction process (described below) could produce oil from oil shale at approximately $30 per barrel, using electricity to heat the shale in situ.

U.S. Oil Shale Resources

Buried underground in western Colorado are a trillion tons of oil shale. Recently, the DOE published a new report on oil shale extraction processes. It claimed that the nation could wring "200,000 barrels a day from oil shale by 2011, 2 million barrels a day by 2020, and ultimately 10 million barrels a day" from fields in Colorado, Utah and Wyoming. See "High-Temperature Reactors for In Situ Recovery of Oil from Oil Shale," supra. It is said that the tri-state area contains enough oil shale to produce 800 billion barrels of oil, which is estimated as a 100-year supply for the United States, and three times the oil in Saudi Arabia. If these predictions could be realized, the economic and political benefits to the United States would be substantial.

Energy Content of Oil Shale

A major problem encountered in developing oil shale resources has been that the energy in oil shale is not in a form that can be used directly without costly processing, with the exception of direct combustion of oil shale which is not contemplated currently in the United States (although it has been practiced in China and Israel). Coal seams a few feet thick are worth mining because coal contains great amounts of energy that can be consumed by direct combustion without costly processing. Oil produced from conventional petroleum reservoirs contains even more energy. While coal can be converted into liquid hydrocarbons, the process is relatively expensive because coal contains relatively less hydrogen for direct conversion to liquid products. Nonetheless, the technology is proven and has been practiced in South Africa for decades.

Current and Future Prospects for Oil Shale Exploitation

In the last 150 years, humans have used 1 trillion barrels of conventional oil. The second trillion will be consumed in the next 30 years. Given projected demand for fuel, oil companies have been experimenting with new ways to produce shale oil. A Shell in situ process under consideration avoids mining. Shell has disclosed portions of its proposed technology in Vinegar U.S. Pat. No. 6,997,518 (the Vinegar '518 patent) (issued Apr. 24, 2002), assigned to Shell Oil Co. This patent also extensively reviews the prior art and lists prior art references in the field of this invention. The Vinegar '518 patent is incorporated herein by reference as if fully set forth herein.

Shell proposes to heat a 1,000-foot-thick section of shale to 700° F. and then keep it that hot for three years. Inside a 100-acre production plot, Shell would drill as many as 1,000 wells. Next, long electric heaters would be inserted in preparation for a multi-year bake. Shell hopes to derive 20 billion barrels of oil, roughly equal to the remaining reserves in the lower 48 states, in 100 years from a 6-mile-by-6-mile area.

Although Shell's oil shale extraction process avoids the need to mine shale, it requires a great amount of electricity. To produce 100,000 barrels per day, the company would need to construct the largest power plant in Colorado history. Costing about $3 billion, it would consume 5 million tons of coal each year, producing 10 million tons of greenhouse gases. (The company's annual electric bill would be about $500 million.) One million barrels a day would require 10 new power plants, and five new coal mines. Shell plans to do more experiments, before making a final go/no-go decision by 2010. A major concern is the yield. It is uncertain whether the Shell oil shale extraction process would need more energy to produce a barrel of oil than a barrel contains.

There exists a need for an oil shale extraction process that avoids or lessens the problems discussed above. Such an oil shale extraction process would be in situ, would not require provision of large amounts of energy (especially electrical energy) from an external source, would be relatively inexpensive, and would avoid mining.

SUMMARY OF THE INVENTION

This invention is directed to a system and process for retorting and gathering hydrocarbons from oil shale. Heat energy is delivered to a subterranean body of oil shale to be retorted by drilling cased wells down into the oil shale deposit, to a proximal end of the bottom of the body of oil shale to be retorted, and then under and across the body of oil shale to be retorted, to its distal end. The casing under the body of oil shale to be retorted is a fluid transmission pipe through which a heated fluid (steam or a synthetic fluid) circulates; the heating fluid is at a temperature sufficient to retort oil shale. The fluid transmission pipe is part of a substantially closed loop heat delivery module, so that the heating fluid does not physically contact the oil shale or other subterranean environment and thus risk polluting it or risk losing expensive heating fluid. (The system is termed substantially closed, because some leakage at joints or at pressure relief valves is unavoidable, over the contemplated multi-year operation.) While the heating fluid in the fluid transmission pipe transmits heat energy to the oil shale above and proximate to the fluid transmission pipe, that is not the only heat transfer mechanism. Vapor conduits ("spider wells") are drilled in the body of oil shale to be retorted, above the fluid transmission pipe, so that retort vapors resulting from the conduction heating of the oil shale above and proximate to the fluid transmission pipe ascend through the conduits. The vapors cool and condense when they reach cooler parts of the body of oil shale to be retorted above the fluid transmission pipe, so that they carry some heat upward by convection and upon condensation they reflux, thereby giving up their latent heat of vaporization to the surrounding oil shale. As the kerogen in the oil shale is converted to hydrocarbon vapors and liquids, the oil shale becomes more permeable, thereby promoting flow of retort vapors and liquids through the oil shale.

The hydrocarbon gathering system of the invention comprises cased production wells drilled down to the top of the body of oil shale to be retorted. A central casing continues to the bottom of the body of oil shale to be retorted, where a sump is located. The spider wells transmit condensed retort liquids downward to their lower ends at the bottom of the body of oil shale to be retorted, where the liquids percolate through the oil shale there that has become more permeable because of kerogen conversion, to the sump. The spider wells transmit retort vapors upward to their upper ends, which communicate with the central casing at or near the top of the body of oil shale to be retorted, thereby transmitting the retort vapors to the central casing. Retort vapors and liquids are extracted via the spider wells and central casing, and are collected and processed at the surface.

DETAILED DESCRIPTION OF THE INVENTION

Figure 1:
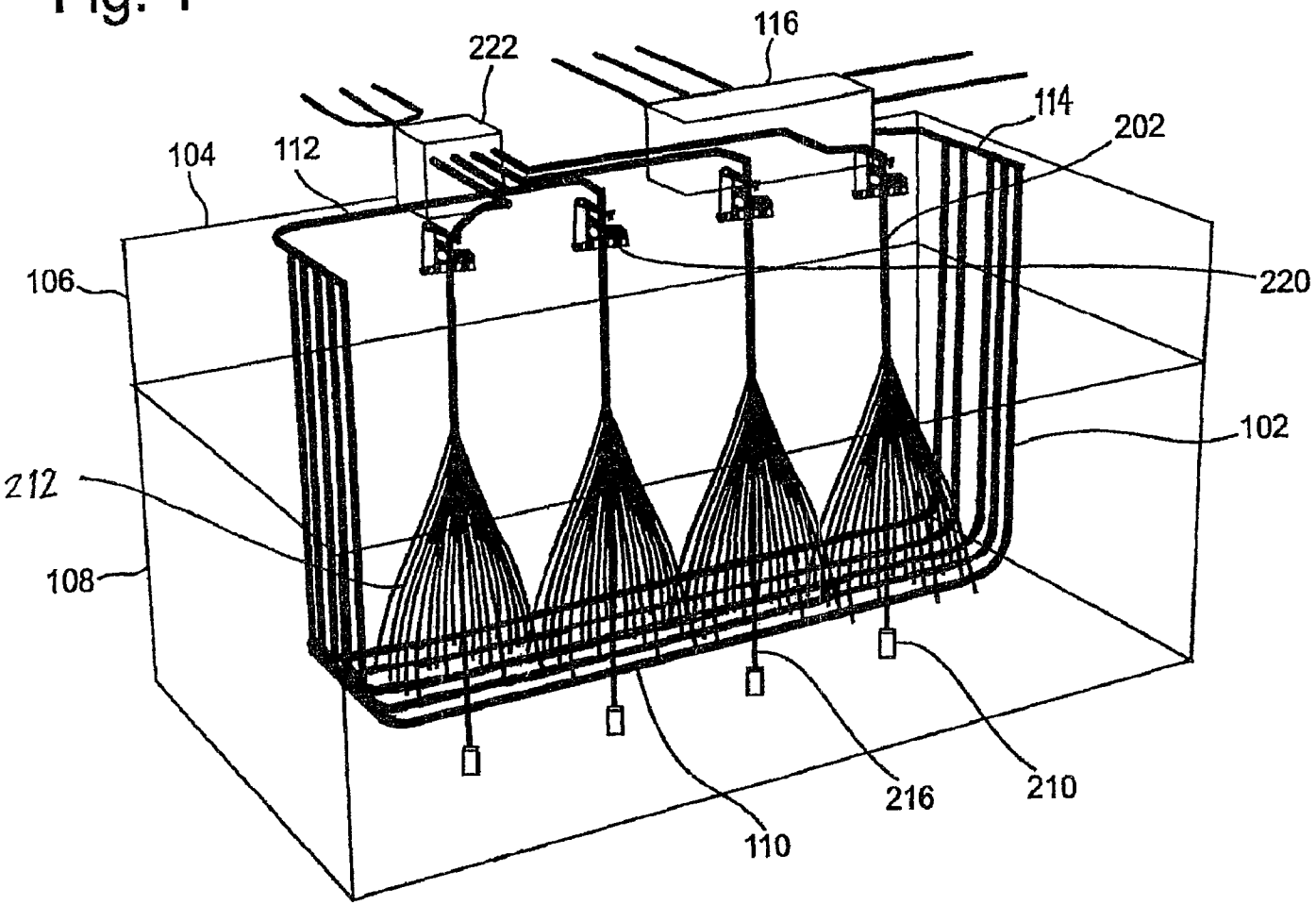
FIG. 1 is a perspective drawing showing the energy delivery subsystem and the hydrocarbon recovery subsystem of the invention, showing five cased energy delivery wells and four hydrocarbon recovery wells.

The oil shale extraction system (and process) of this invention includes two major subsystems (sections): energy delivery and hydrocarbon gathering or recovery. The specific process and system described hereinafter are directed to embodiments that illustrate the principles of the invention. The specific process and system described hereinafter are readily modified to the requirements of different settings by expedients well known to persons of ordinary skill in the art of drilling and completing oil wells. ("Completing" an oil or gas well refers to the process of finishing a well so that it is enabled to produce oil or gas. Completing a well may involve one or more of the steps, among others, of installing the well casings, cementing the well, perforating the casing, installing the wellhead, and installing lifting equipment. For readily accessible, online treatments of well completion, see <www.naturalgas.org/naturalgas/well_completion.asp> and <http://en.wikipedia.org/wiki/Oil_well#Completion>, last visited Dec. 21, 2006.)

A first embodiment described below is directed to the extraction of shale oil and other hydrocarbons from a subterranean body of oil shale within the top 300 feet of the oil shale deposit below a 2.5-acre surface plot located in the Piceance Basin of Colorado. In this embodiment, the body of oil shale to be retorted is a rectangular column approximately 100 feet wide, 1000 feet long, and 300 feet thick; the top of the body is at a depth of approximately 1000 feet (i.e., underneath approximately 1000 feet of overburden) and the bottom of the body is at a depth of approximately 1300 feet. The embodiment contemplates successive retorting of similar, adjacent subterranean bodies of oil shale and moving the equipment as necessary to do so. A second embodiment, directed to the extraction of shale oil and hydrocarbons from a subterranean body of oil shale within the top 1000 feet of the oil shale deposit below a 20-acre plot in the Piceance Basin of Colorado, is then described. Each well pattern in this second body of oil shale to be retorted is a column of oil shale approximately 400 feet wide, 2000 feet long, and 1000 feet thick; as before the body of oil shale to be retorted is under 1000 feet of overburden. In each site, there are approximately 25 gallons of oil per ton of oil shale in the top 300 feet of the deposit (the Mahogany and plus R6 zones) and a slightly lesser or equal amount in the next 700 feet.

An important aspect of this invention's departure from the prior art in the field of extraction of oil and other hydrocarbons from oil shale is its use of a closed loop heat delivery module in its energy delivery subsystem. By a "heat delivery module" is meant an assembly of components that performs the task of transferring heat to the body of oil shale that is being retorted to yield hydrocarbons. By a "closed loop heat delivery module" is meant a heat delivery module in which heating fluid and other matter are not transferred more than insubstantially from the module to the oil shale deposit or other external environment, as, for example, would occur in a system that injects steam into the oil shale deposit rather than recycling all of the steam. The distinction is similar to that between a condensing steam engine and a non-condensing steam engine. History from past experiments has shown that processes that inject fluids into an oil shale deposit have difficulty in recovering the produced hydrocarbons and the injected fluids because they are not confined, and thus production and energy efficiency are decreased. The use of a closed loop heat delivery module both reduces energy expenditures and lessens thermal pollution of the nearby environment. (As previously indicated, the system is "substantially" closed in that minor leakage is unavoidable, especially over the contemplated multi-year operating period.)

Another important aspect of this invention's departure from the prior art in the field is its use of multi-phase oil-shale heating—in particular, the upward dissemination of heat through the body of oil shale above the closed loop heat delivery module. This upward dissemination of heat is effected by hydrocarbon vapors as the kerogen in the oil shale deposit is retorted by the closed loop heat delivery module and is converted into hydrocarbon vapors. This aspect of the invention involves a novel cooperation between the energy delivery subsystem and the hydrocarbon gathering or recovery subsystem in which the hydrocarbon gathering or recovery subsystem acts as a part of the energy delivery subsystem, which it does by delivering heat (including latent heat from refluxing) from the ascending hydrocarbon vapors in a part of the hydrocarbon gathering or recovery subsystem to the oil shale deposit above and proximate to the closed loop heat delivery module.

First Embodiment

For this small scale embodiment, five wells are drilled for energy delivery and four wells are drilled for shale oil and gas recovery from a body of oil shale to be retorted, which is under a plot of land approximately 100 feet wide and 2000 feet long. (The longer dimension of the plot is up to approximately 1000 feet longer than the 1000-foot operational part of the wells, because an up to approximately 500-foot radius of curvature is required for the pipe to make a transition from a vertical to a horizontal orientation, and vice versa—as explained below.) The number of energy delivery wells drilled determines the production rate and the concomitant required heat input. The number and distribution of wells therefore reflects site-specific engineering trade-offs. The entry wells for energy delivery are at one 100-foot wide end of the plot and the exit wells are located at the other end; a single well drilling pad may be used for all five entry wells and another for all five exit wells, but the wells are evenly spaced apart (laterally) at about 20 feet intervals. The four production wells for oil and gas recovery are evenly spaced about 250 feet intervals along the middle 1000 feet of the 2000-foot length, so that each production well accounts for that part of the body of oil shale to be retorted that underlies a 100 ×250 foot part of the surface plot.

Energy Delivery

Energy Delivery Wells

Figure 2:
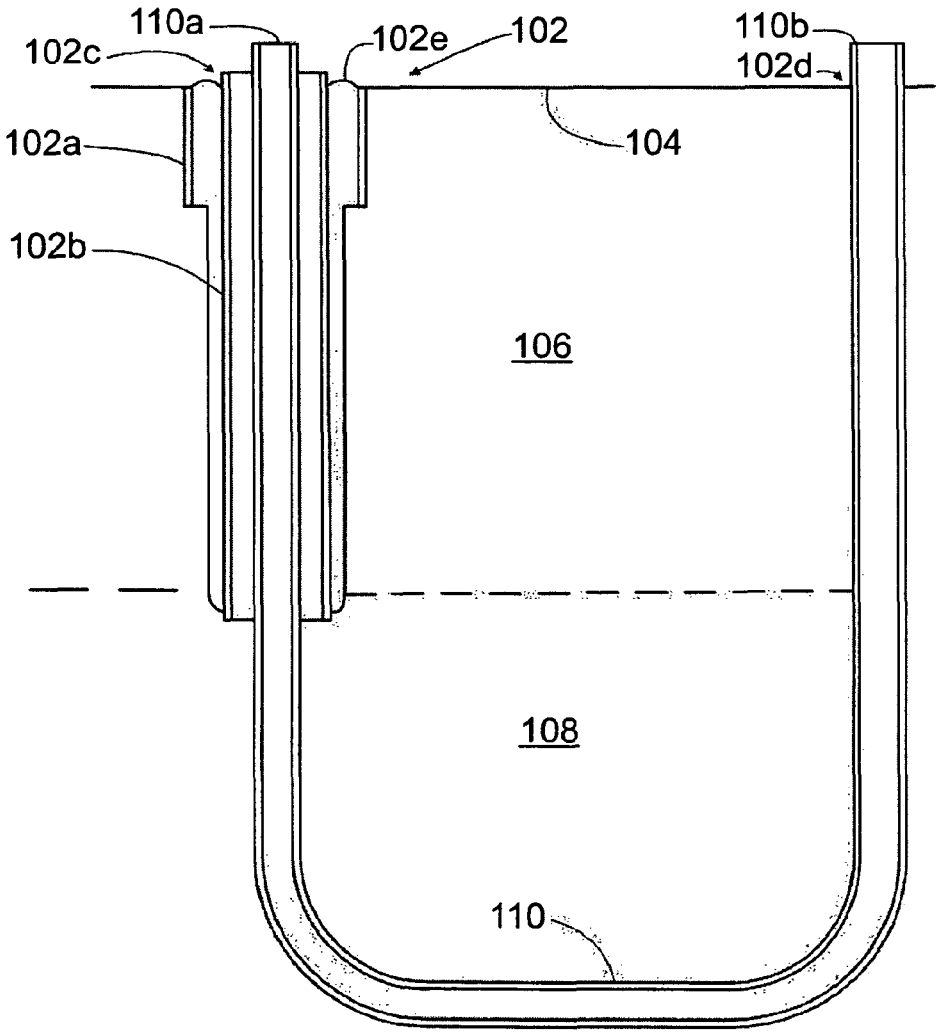
FIG. 2 is a cross-sectional drawing of one cased energy delivery well of the energy delivery subsystem of the invention.

Energy delivery subsystem 100, as shown in FIGS. 1 and 2, delivers energy to the oil shale formation via heat transfer from a substantially closed loop system, which minimizes potential contamination and environmental problems for both the site surface and the subsurface hydrology, and also minimizes loss of any expensive fluid heat transfer media. Energy delivery subsystem 100 comprises a row of five parallel energy delivery cased wells 102 approximately 20 feet apart from one another.

Each well 102 descends generally downward (vertically or aslant as the setting requires) from the earth's surface 104. A 13⅜ inch diameter surface casing 102*a* for well 102 is drilled down through a 17½ inch nominal diameter borehole for the first approximately 100 feet. The borehole is then reduced to a nominal 12¼ inch diameter and it is drilled through approximately 1000 feet of rock overburden 106 to the top of oil shale deposit 108. A 9⅝ inch overburden casing 102*b* is used to case well 102 throughout the overburden as well 102 is drilled through it. This is done with conventional oil drilling techniques. (All diameters are approximate. In some areas, such as that of the first embodiment, the subsurface is hard rock all the way up to the earth surface. In other areas, the uppermost portion of the subsurface is dirt or loose material, and the surface casing can simply be driven through it. As used hereinafter, the terms drill, drilled, and similar words will be used to include both drilling casings and driving them.) Casings 102*a* and 102*b* are cemented in place using high temperature insulating cement 102*e*.

In this embodiment, referring to FIG. 2, the body of oil shale to be retorted extends from the bottom of overburden 106 (and top of oil shale deposit 108) 300 feet down to the bottom of the body of oil shale to be retorted, or to approximately 1300 feet below the earth's surface. Well 102 is to make a transition from its initial generally vertical orientation to a generally horizontal orientation, so that well 102 can then run for approximately 1000 feet across the bottom of the body of oil shale to be retorted, from a proximal end of the body to a distal end thereof 1000 feet away. This change in orientation requires the use of deviated or directional drilling. The 90° transition of the casing from a vertical to a horizontal orientation would require a vertical radius of curvature of up to several hundred feet, depending primarily on casing diameter—the required radius of curvature being lower with smaller diameter pipe. If well 102 is drilled aslant, however, instead of a 90° transition, the transition may involve a more obtuse angle, such as 120°, so that the bending is less severe. In any case, the transition in orientation of well 102 requires a setback relative to the longitudinal dimension of the body of oil shale to be retorted, so that the surface location of well 102 where it enters the earth is set back longitudinally with respect to the proximal end of the body of oil shale to be retorted.

At the bottom of overburden 106 (and the top of oil shale deposit 108), overburden casing 102*b* is replaced by a 5½ inch casing, fluid transmission pipe 110, which is the only casing used for the remainder of well 102. Fluid transmission pipe 110 extends continuously throughout the length of well 102, and may advantageously be implemented with thermally insulated tubing in the portions that do not run horizontally under the body of oil shale to be retorted. Pipe 110 runs initially through casings 102*a* and 102*b*, located concentrically therein, and then continues by itself in a decreased diameter well bore. Fluid transmission pipe 110 has an injection end 110*a* extending out from an entry end 102*c* of well 102, and has a return end 110*b* extending out from an exit end 102*d* of well rejected under 35 U.S.C. §102 for alleged anticipation by After entry from the surface and the transition to a generally horizontal orientation, fluid transmission pipe 110 extends generally horizontally for 1000 feet under the body of oil shale to be retorted. Fluid transmission pipe 110 then makes a transition generally upward, to provide the final, exit section of well 102. Fluid transmission pipe 110 passes up through oil shale deposit 108, passes through overburden 106, returns to surface 104, and then passes through exit end 102*d* of well 102 to reach return end 110*b* of fluid transmission pipe 110.

Energy delivery wells 102 are part of a closed system through which a fluid heat transfer medium ("heating fluid") (not illustrated) is to be circulated after being heated, as described below, once the well drilling is completed. Thus, the fluid transmission pipes 110 form parts of a substantially closed energy delivery system (closed loop heat delivery module) through which the heating fluid can circulate without being transferred to the oil shale deposit or other external environment, as, for example, would occur in a system that injects steam into the oil shale deposit.

The entry and exit sections of cased wells 102 are cemented to a depth of approximately 1000 feet from the surface with high temperature insulating cement 102*e* to reduce heat loss from fluid transmission pipes 110 into the overburden. The cement thus provides thermal insulation for each cased energy delivery well 102, thereby conserving energy usage and reducing thermal pollution of the overburden that might be detrimental to ground water located in the overburden. The cement may advantageously be prepared as class "G" cement with 35% silica flour, 3% $CaCl_2$, and 10% spherellite. It is known, also, to prepare thermal insulating cement with bubble alumina or exfoliated vermiculite as aggregate, or to use foamed cement (with or without aggregate) to minimize cost. Other cements may also be used if they are capable of substantially lessening heat transmission from the overburden casing to the surrounding overburden.

Heating

The five fluid transmission pipes 110 are combined in an energy delivery manifold 112 at injection ends 10*a* of the fluid transmission pipes 110 and in a return manifold 114 at the return ends 110*b* of fluid transmission pipes 110. The manifolds communicate with the heating subsystem, which can be conventional and is not claimed as such as part of the invention. Heating may be effected by various different conventional means as a matter of design choice, only one of which means is described hereinafter.

The heating fluid is heated in a boiler 116 to the necessary final retorting temperature. It has been ascertained that, while surface retorting for a period of no more than a few hours requires a retorting temperature of 445-500° C. (833-932° F.), in the underground, in situ process of this invention, where the retorting may extend for years, the retorting range can be lower—approximately 500 to 750° F. Therefore, in practicing this invention, the heating fluid is heated to at least 500° F., but no more than approximately 1100° F., by surface-based combustion and heat transfer equipment. After exit from the boiler via an exit port thereof the heated fluid passes to a pump and then to energy delivery manifold 112, for routing to the energy delivery wells. (The pump may be located elsewhere in the closed loop system—for example, between the boiler and return manifold 114—if that is more convenient. Moreover, if the heating fluid used is steam, the pump may well be unnecessary because the steam pressure may be sufficient to circulate the heating fluid.) The heating fluid is pumped to sufficient pressure for circulation through the entire system, which is approximately 100 to 1000 psi, depending on the depth of the oil shale to be retorted and the heating fluid used. Then the heated fluid is conveyed from manifold 112 into energy delivery wells 102 via the injection ends 110*a* of fluid transmission pipes 110, and the fluid then provides heat to the body of oil shale to be retorted. The heating fluid then returns at the surface via fluid transmission pipes 110 and return manifold 114 to the boiler via an entry port thereof for recycle.

A number of heating fluids can be used, and the system may advantageously use in sequence different heating fluids during different phases of the project. Steam is preferably used during the initial heating phase. Steam has the advantages of high heat transfer coefficients in the interior of the pipe, excellent carrying capacity of energy due to its high latent heat of vaporization, and the ready availability and low cost of package steam boilers. Conventional steam technology has been applied in ongoing steam-flood oil recovery projects for the past 50 years and is readily used in practicing this invention. During the later stages of carrying out the process of this invention it is desirable to use a high temperature synthetic heat transfer medium, such as Dowtherm A,™ Syltherm,™ or Paratherm.™ (Dowtherm and Syltherm are trademarks of Dow Chemical Co. Paratherm is a trademark of Paratherm Corp. Dowtherm A has an atmospheric boiling point of 495° F., which approximates the lower end of the long-term underground retorting temperature range. The heating fluid can deliver its latent heat of vaporization to the body of oil shale to be retorted only if its temperature is initially above and finally below the boiling point, during its passage through the generally horizontal portion of fluid transmission pipe 110.) Other heat transfer fluids can also be used that can be heated to the temperature necessary to retort oil shale.

Heat energy is supplied to combustion and heat transfer equipment and the boiler in initial operations by combusting natural gas or LPG, and subsequently from shale-derived retort gas when it becomes available on site in suitable form. Retort gas extracted from oil shale deposit 108 is intended to be the primary long-term source of heat, but subsystem 100 is also capable of combusting other gaseous or liquid fuels, such as LPG and shale oil.

Studies, small scale tests in the United States using Colorado oil shales, and commercial plants in Israel and China have indicated that high temperature steam (and electric power) can also be produced from the direct combustion of oil shale, and thus such a source of energy can be employed for purposes of this invention with the future evolution of oil shale mining operations. A great advantage of combusting Colorado oil shales is that sulfur emissions are essentially nil, because the natural components in Colorado oil shales absorb the sulfur compounds.

Because the foregoing heat transfer system, energy delivery subsystem 100, is closed it minimizes potential contamination and environmental problems, as well as possible loss of expensive heat transfer media or subsurface water. The system also has the advantage of being able to supply heat to retort oil shale from horizontal heating wells located below the body of oil shale to be retorted, in contrast to systems that deliver heat to retort oil shale from vertical wells that contact much less oil shale and thus require many more wells to retort the same underground body of oil shale. Moreover, this energy delivery system leaves a very small surface footprint, with minimal surface disruption. The entry section of the energy delivery well is advantageously drilled by deviated or directional drilling technology through a single conduit pipe from a single drill pad for multiple heating wells, thus minimizing surface impact. Likewise, the exit section of the energy delivery well penetrates the surface upwardly and generally vertically over a very small area, with the same advantageous result.

Hydrocarbon Recovery Subsystem

Figure 3:
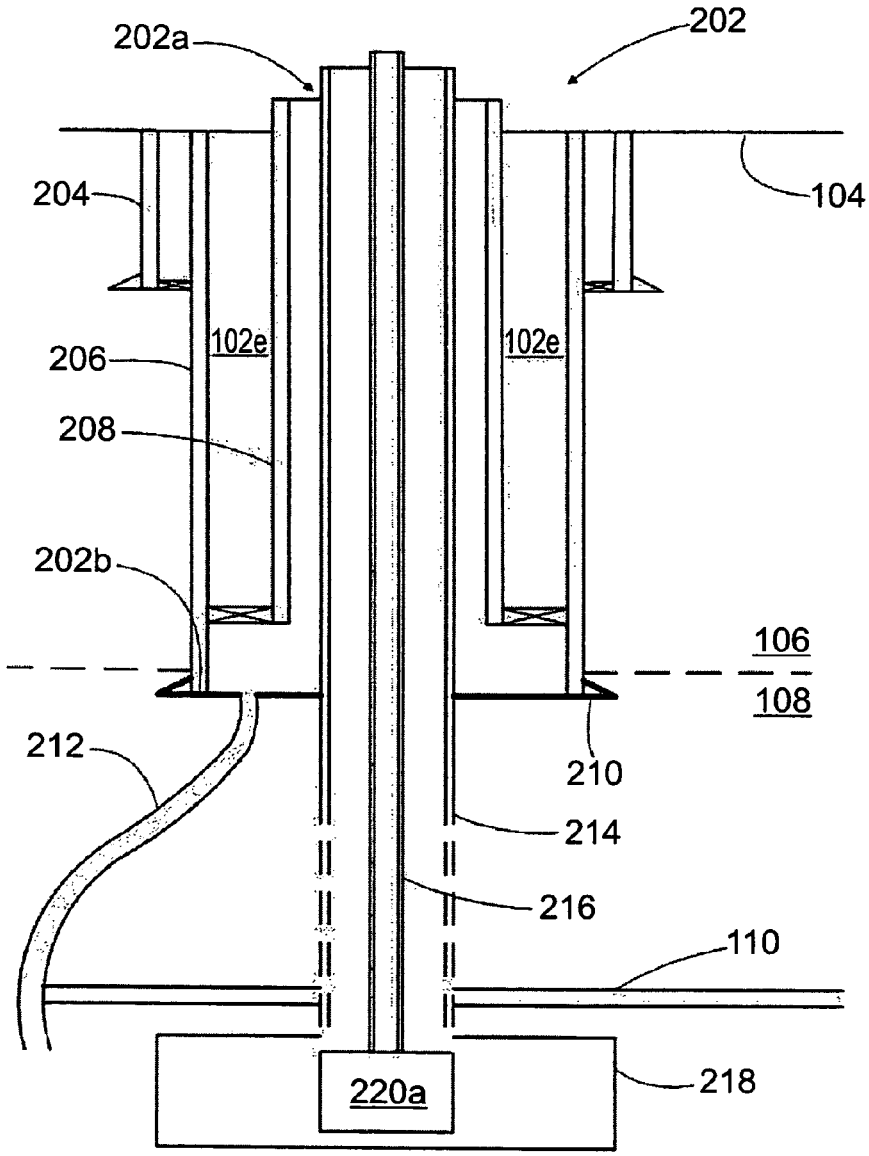
FIG. 3 is a cross-sectional drawing of one production well of the hydrocarbon recovery subsystem of the invention, together with one of its spider wells.

A further aspect of the invention is the hydrocarbon gathering or product recovery subsystem 200, shown in FIGS. 1 and 3. Subsystem 200 is designed to efficiently collect and maximize recovery of hydrocarbon products from retorted oil shale.

Overview of Hydrocarbon Recovery Process

This invention utilizes mechanisms for oil generation and recovery that are multiple and complex. For example, a principal means of oil generation is through kerogen decomposition in the high temperature zone that energy delivery subsystem 100 (in particular, the generally horizontally running part of fluid transmission pipe 110) develops in its proximity by direct conduction of heat. Kerogen, a precursor to oil referred to supra in the Background section, is composed of complex carbon and hydrogen rich molecules in solid form occupying porosity in the shale. As a solid, kerogen does not flow and makes the oil shale containing it essentially impermeable to flow. As the kerogen is heated sufficiently (to 500-700° F.), however, it breaks apart and reformulates into hydrocarbon vapors and liquids (i.e., retort vapors and liquids) with some residual char (carbon). Once this conversion occurs, the shale becomes more permeable as both the vapors and liquids flow freely.

As kerogen decomposition proceeds, oil, gas, and water are generated, porosity forms in the oil shale where kerogen has decomposed, and the oil shale becomes more permeable. The light ends from the oil fraction distil out of the heavy ends and migrate upward. They travel through any fractures and via permeability present in the oil shale, created by fracturing of the spider wells (described below), or created by retorting of the oil shale. In addition, they migrate upward through the spider wells (as described below). These hydrocarbons and water vapor tend to move upward, heating the oil shale by convection during the process. Any water initially present in the formation, or that which is produced during shale oil generation, is vaporized and migrates along with gas, oil distillate, and oil.

As oil vapor and water vapor reach cooler portions of the oil shale deposit, condensation occurs, with heat liberation due to the latent heat of vaporization of these materials imparting heat to and retorting the oil shale. This refluxing process is an important mechanism for heat transfer from hot to cold zones of the oil shale deposit, in this invention. Because of the presence of multiple fluid phases, flow patterns in the permeable or fracture system are complex. As hydrocarbon gas, distillate, and oil move into the regions of the oil shale deposit that contain the product recovery systems, they are collected in recovery zones and are transported to the surface. Much of the hydrocarbon is recovered at the surface as vapors. But until any given part of the site nears the end of its recovery operation, much of the retorted hydrocarbon vapor product refluxes, thereby delivering its latent heat to the proximate region of the oil shale deposit. It then condenses, falls downward, and then is collected in a sump (from which it is pumped to the surface) or before that can happen it is re-vaporized and recycles upward through the progressively more permeable oil shale.

Prior to the conversion of the kerogen, some type of vertical permeability/heat transfer conduit is needed to allow the heat and hydrocarbon gases and liquids produced initially near the horizontal portion of fluid transmission pipe 110 to move to the surface and be collected and also to contact additional as-yet unconverted oil shale, conveying heat to it through the processes of conduction, convection, and reflux. Vapor conduits or "spider" holes provide these conduits on a regular spacing sufficient to convey heat and to collect converted hydrocarbons.

Vapor Conduits

As the term is used hereinafter, a spider well (or spider hole) is a well drilled out laterally from a generally vertical main borehole, the spider well then proceeding generally downward in a curved path. A spider hole or spider well is usually drilled by deviated or directional drilling and/or by coiled tube drilling. It is considered that now imminent development of microhole drilling will permit spider wells to be drilled with microhole equipment, which the DOE states will provide boreholes of 1 to 1½ inches or smaller. Moreover, the DOE reports, relatively deep holes with diameters as small as 1.175 inches have been drilled using mining coring rigs, for at least 50 years. See U.S. Dep't of Energy, Office of Fossil Energy, "Microhole Technology: A Systems Approach," March 2006 (available and last visited Dec. 14, 2006, online at <www.net1.doe.gov/technologies/oil-gas/publications/brochures/Microhole2006_Mar.pdf>); see also U.S. Dep't of Energy, Office of Fossil Energy, "Microhole Systems R&D," Oct. 18, 2006 (available online at <www.fossil.energy.gov/programs/oilgas/microhole/index.html>, last visited Dec. 14, 2006). Use of such small boreholes for vapor conduits or spider wells is therefore considered within the scope of the invention, and such microholes are considered within the scope of the terms "vapor conduit," "spider well," or "spider hole" as used herein. The DOE states that, when used for field development, microholes may be less than half as expensive as conventional wells. That would make it economical to increase the number of spider wells per production well, thereby increasing the rate of kerogen conversion and the rate at which a given well pattern could be fully exploited.

In a preferred embodiment, the vapor conduits of this invention are spider holes, drilled out from the walls of production wells. However, the vapor conduits could in principle be independent boreholes, for example, as microholes. Such microhole boreholes can be singly drilled vertically down from the surface. In addition, microhole vapor conduits can be drilled up or down, singly or in multiple, from a laterally drilled borehole. For example, a first borehole (which may itself be a microhole) may be drilled laterally to traverse a path generally parallel to fluid transmission pipe 110, and at approximately the same depth as fluid transmission pipe 110 (i.e., at the bottom of the body of oil shale to be retorted); several microhole vapor conduits may then be drilled in succession from the first borehole upward through the body of oil shale to be retorted. By the same token, the first borehole may be located at a higher depth and the microhole vapor conduits may then be drilled downward from it.

In a preferred embodiment, the vapor conduits have a dual function: facilitating heat transfer and extraction of retort vapors. In other embodiments the functions may be separated.

Hydrocarbon Recovery Wells

As indicated above, and as shown in FIG. 1, five fluid transmission pipes 110 extend under and across the body of oil shale to be retorted for a distance of about 1000 feet. Four large diameter cased production wells 202 for hydrocarbon recovery are disposed along this 1000 foot distance, spaced approximately every 250 feet. Wells 202 are drilled and cased through the 1000 feet of overburden to the top of the oil shale recovery zone 108, and are cemented with insulating cement 102*e*.

As shown in FIG. 3, a series of casings are used in production well 202. First, surface casing 204, approximately 24½ inches in diameter, is drilled down from earth surface 104 for approximately 100 feet.

Located within surface casing 204 and cemented to surface 104 is outer overburden casing 206, approximately 18⅝ inches in diameter. Outer overburden casing 206 is drilled approximately 1000 feet down from the bottom of surface casing 204 through overburden 106 to the bottom of overburden 106 and the top of the body of oil shale. An inner overburden casing 208, approximately 7 inches in diameter, extends through casings 204 and 206, concentrically therewith, from an upper end 202*a* of production well 202 at surface 104 to a "packer" located slightly above a lower end 202*b* of outer overburden casing 206. The annulus between outer and inner overburden casings 206 and 208 is isolated by the packer, so that fluid passage upward through the annulus is blocked. In addition, this annulus is filled with an insulating material 102*e*. Insulating material 102*e* can be thermal insulating cement, but if it may be necessary subsequently to pull the 7 inch casing, at any time, it is better to use any of numerous available liquid insulating materials.

A shoe 210 is located at lower end 202*b* of casing 206 to close off the bottom of well 202 at this depth, except insofar as other elements of the well extend downward through the shoe. The diameter of shoe 210 is approximately 18⅝ inches, and it has enough clearance between it and the bottom of inner overburden casing 208 to provide a chamber into which retort vapor can be admitted for transmission by pressure differential upward to the surface for processing. Approximately six or more small diameter (approximately 1½ to 6 inch diameter) recovery wells ("spider wells") 212, only one of which is shown in FIG. 3, are directionally drilled in a radial pattern out from under shoe 210 and through the body of oil shale to be retorted to its bottom, to act as vapor conduits. (In the hydrocarbon recovery subsystem of this invention, the spider wells 212 extend down from slightly below the shoe at the bottom of the overburden casings like the legs of a spider extending down from its body.) The spider wells are drilled in a three-dimensional pattern using coiled tubing techniques. As shown in FIG. 1, the three-dimensional pattern is in the general shape of an onion dome or ogee, curving out from wells 202 and then extending downward, spreading out along and around the horizontal portion of fluid transmission pipe 110.

As shown in FIG. 1, the spider wells are dispersed over and along the horizontal sections of the fluid transmission pipes in a manner that facilitates hydrocarbon recovery by covering the entire base area of the body of oil shale to be retorted, for each hydrocarbon recovery well (production well). For example, if there are six spider wells 212 per production well 202, the spider wells are advantageously arranged with three spider wells 212 on each side of fluid transmission pipe 110, and the 250-foot horizontal distance along fluid transmission pipe 110 that each production well 202 accounts for would entail a spacing of approximately 80 feet between the bottoms of spider wells on the same side of a fluid transmission pipe 110. Because the lateral distance between adjacent fluid transmission pipes 110 is only approximately 20 feet, it is advantageous to stagger the locations of the bottoms of the spiders wells located on the opposite sides of a given fluid transmission pipe (for example, at 40 feet intervals). Such well placement optimizes hydrocarbon production and energy efficiency.

In a preferred embodiment the spider wells are, in whole or in part, open hole and gravel packed (with fine gravel or sand) to provide hole integrity and permeability to the movement of retort vapors and liquids. (As used herein, gravel packing includes packing with sand.) At their upper ends, the spider holes feed into the chamber above shoe 210 and from there to the annulus within inner overburden casing 208. In another embodiment, the spider wells are cased, at least in part, but the casings should not extend all the way to the bottom of shoe 210, to avoid clearance problems, and the casing should be perforated to permit retort vapor and liquid to pass between the oil shale and the spider well. Optionally, the oil shale may be fractured from the spider wells to enhance the permeability of the oil shale and thus enhance flow and transport of oil and vapors.

To the extent that retort vapors do not condense and reflux, the vapors ascend through the spider wells to the upper ends thereof, where the spider wells transmit the vapors to the annulus of casing 208, and (as indicated above) the vapors then move by a pressure differential to the surface where they are collected for processing. The spider wells provide conduits on a regular spacing sufficient to convey heat through the body of oil shale to be retorted and to collect converted hydrocarbons. As fluid transmission pipes 110 heat adjacent portions of the oil shale deposit by conduction, a "heating plane" is formed that ascends slowly, defining a heat gradient within the oil shale deposit. The spider wells intersect the heating plane, so that any converted hydrocarbons always have a free pathway to move upward via the spider wells through the oil shale deposit, to be collected. Without the spider wells, it would be necessary to space production wells 202 much more closely to provide heat conduits and extraction paths for retort products. The optimum number of spider wells for a given production well is determined by engineering cost-benefit trade-offs. If the spider wells are microholes, their drilling cost is lower and their number and density of distribution may advantageously be increased relative to that for conventional drilling.

After the spider wells are drilled and completed, the central borehole is continued downward through shoe 210 and through the body of oil shale to be retorted, to its bottom. Below the bottom of the overburden the borehole size is reduced to accommodate a 4½ inch casing, hydrocarbon production casing 214. This 4½ inch casing extends above production well upper end 202*a* and proceeds downward to approximately the bottom of the body of oil shale to be retorted. Below the bottom of the overburden, casing 214 is perforated to permit passage of retort vapor between the body of oil shale being retorted and casing 214. Located within casing 214, and running longitudinally therethrough from above the earth surface to approximately the bottom of the body of oil shale to be retorted, is a 2⅜ inch diameter product gathering pipe 216, through which retort liquids are gathered and transmitted to the surface. In the annulus within 4½ inch perforated casing 214 (outside of and surrounding 2⅜ inch pipe 216), vapors that have not condensed are gathered and ascend for collection at the surface.

At the bottom of perforated casing 214, which is also the bottom of the body of oil shale to be retorted, the borehole is underreamed to a depth below that of fluid transmission pipe 110, which carries the heating fluid under the body of oil shale to be retorted. The underreaming provides a sump 218, approximately 1 foot in diameter and 10 feet deep, in which retort liquid (shale oil) gathers and from which it is pumped into the lower end of 2⅜ inch product gathering pipe 216 for transport to the surface. (The sump is further described below.)

At their upper ends, the four 7 inch casings of the four production wells 202 are manifolded to deliver the pumped hydrocarbons to a conventional processing subsystem at the surface. The four 2⅜ inch product gathering pipes 216, conveying retort liquids, are also manifolded at the surface for processing. The 7 inch casings are advantageously implemented with thermally insulated tubing, and the 18⅝ inch to 7 inch annulus is filled with a thermal insulating material 102*e* from surface 104 to the bottom of overburden 106. (As previously indicated, this material may be cement or may be a liquid insulating material to facilitate later pulling the casing.) This expedient both protects the overburden from adverse groundwater effects and maintains fluidity of transported hydrocarbons.

When ascending retort vapors reach cooler portions of the oil shale and then reflux, the resulting condensed liquid is able to descend down the spider wells to their bottoms (or similarly descend via the annulus of perforated casing 214). At the bottoms of the spider wells, kerogen conversion causes the oil shale to become more permeable, so that condensed vapor products flow through the now more permeable oil shale to product gathering pipes 216. The sump 218 created at the bottom of each product gathering pipe 216 collects the condensed shale oil. Each cased production well 202 has an extraction pump, shown in FIG. 1 as pump jack 220 on the surface, from which production well 202 extends downward from surface 104. The condensed shale oil at the sumps is pumped or otherwise moved from the sump to the surface via product gathering pipes 216. The pumps can be implemented as "pump jacks" connected by rods to rod-actuated down-hole pumps 220*a* in the sumps or the shale oil may be extracted by gas lifting or other oil pumping expedients. The rod from the pump jack to operate the down-hole pump may advantageously be located within the 2⅜ inch pipe 216.

As vapors move from the hydrocarbon recovery wells they are transported from each well and collected on the surface for processing in processing unit 222. First, they move by pressure differential through a cooler (for example, a cooler in which air is circulated past heat exchange tubes containing the vapors) and then to a three-phase separator where liquid hydrocarbons (oil), hydrocarbon gases, and liquid water are separated. The water and oil are stored in tanks and the gas is further processed for internal use as a fuel or for sale as natural gas. Oil collected from the pumps in the hydrocarbon recovery wells either flows directly into storage tanks or to the three-phase separator.

The design of the product recovery system for a given site depends to a large degree on the results of resource characterization studies. For example, if Nahcolite or Dawsonite zones or lenses are present, they may be leached or partially leached and incorporated into the product delivery system. Alternatively, the product recovery wells can be under-reamed or highly fractured in the near vicinity of the bottoms of the spider wells, in order to provide collection zones of very high permeability and porosity within the reservoir.

Energy Management and Recovery

Because of the extraordinary energy demands of oil shale processing, efficient energy management is an important aspect of production of oil from oil shale deposits from a plot being subjected to the oil shale extraction process of the invention. The oil shale extraction process of this invention therefore includes energy management methods directed toward maintenance of energy efficiency. First, the process employs indirect heat transfer, in which the heating fluid is segregated from the oil shale deposits in the plot by an energy delivery system comprised of a number of wells that contain a closed loop heat delivery module. This greatly simplifies energy management.

While some energy is consumed in the thermal decomposition of kerogen, these reactions are only slightly endothermic. The vast majority of the energy requirements come simply from heating the huge quantities of rock—oil shale, overburden, and underburden—in the plot under exploitation. During the early stages of retorting of a vertical column of oil shale, the energy input from the energy well pattern is completely utilized in heating the deposit. As the operation proceeds over a period of years, however, the heating fluid leaving the energy delivery wells can reach high enough temperatures that direct reuse poses severe operational problems, because the oil shale deposit does not extract enough heat from the heating fluid to lower its temperature appreciably. During this mid-stage of operations, the exit heating fluid can advantageously be directed by a heat exchanger to an adjacent or nearby well pattern in which operations are just beginning, so that heat is efficiently used for initial reservoir heating of this adjacent well pattern, while the heating fluid is cooled to more easily manageable temperatures. Equally important, as oil recovery from a well pattern nears completion, it becomes possible for a heat exchanger to recover a substantial fraction of the energy in the formation by using the heat stored in this spent pattern from which hydrocarbons have already been extracted to preheat the heating fluid for use in another well pattern where retorting is in an early stage. In this fashion, overall energy recovery is substantially enhanced.

Figure 4:
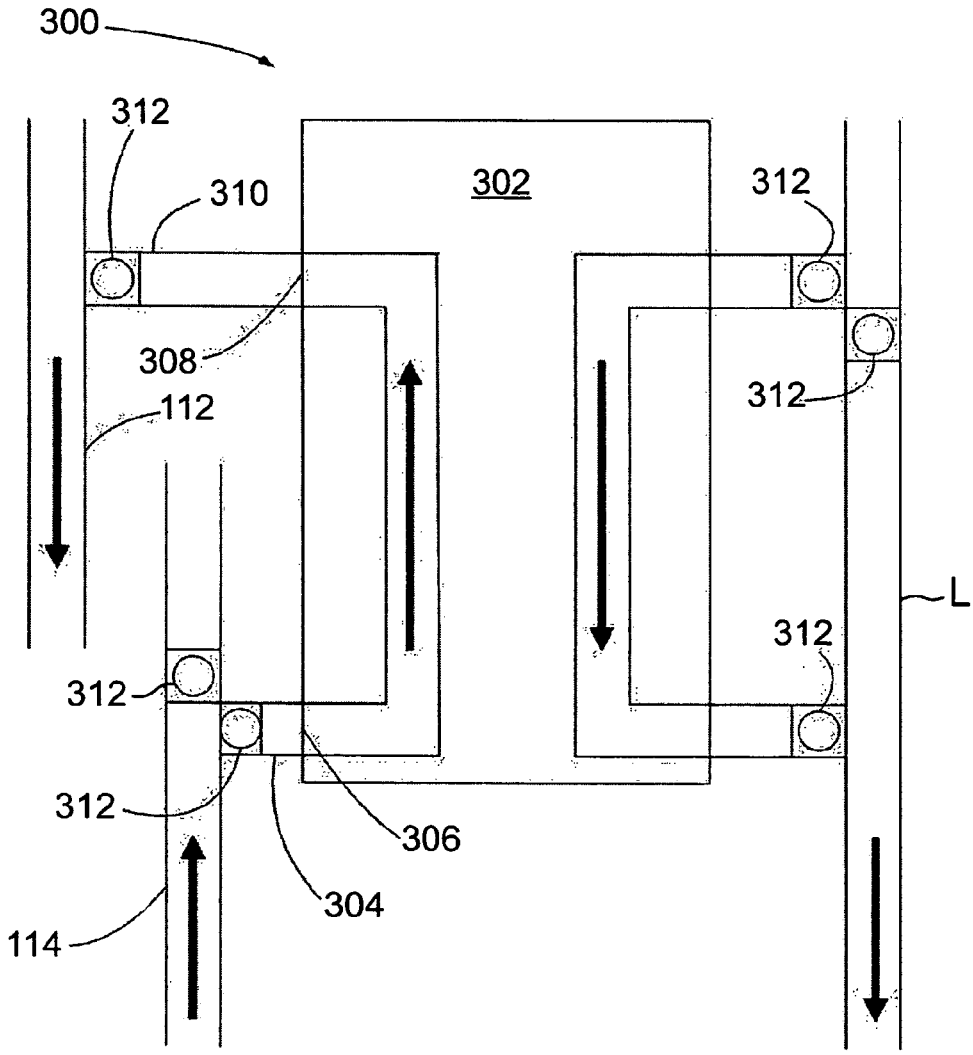
FIG. 4 is a diagram of an energy management and recovery system employing a heat exchanger.

It is therefore desirable to provide a diversion subsystem 300 through which heating fluid is diverted to a heat exchanger 302, and is used to preheat the heating fluid of an adjacent or nearby well pattern. Thus, as shown in FIG. 4, a diversion pipe 304 is connected at one end thereof to return manifold 114 (containing heating fluid exiting from a body of oil shale from which a substantial portion of retortable hydrocarbons has been retorted), so that valves can divert the heating fluid coming from the return ends of the fluid transmission pipes 110 to pipe 304. The other end of diversion pipe 304 is connected to an entry port 306 of heat exchanger 302. The heating fluid passes through heat exchanger 302 to an exit port 308 thereof, to which is connected one end of a return pipe 310. The other end of return pipe 310 can route the heating fluid to boiler 110, or else, if no further combustion heat is to be supplied to the well pattern, the heating fluid is routed around the boiler to delivery manifold 112, which feeds heating fluid to the injection ends of the fluid transmission pipes. Valves 312 are used to control routing of the heating fluid. Heat exchanger 302 is thus inserted in the return line of the closed loop heat delivery module, to extract heat from it. The return line L of an adjacent well pattern, to which the extracted heat is to be delivered, is also routed through heat exchanger 302, to receive the extracted heat and thus preheat the heating fluid in the heat delivery subsystem of the adjacent or nearby well pattern. Line L is in the heat delivery subsystem of a second system that is in an early stage of retorting hydrocarbons from another body of oil shale to be retorted.

Another aspect of energy management concerns maintenance of optimal temperature for operations. The major constituent of oil shale is inorganic mineral material. When oil shales are heated above the decomposition temperature of these minerals, significant energy is required, since these decomposition reactions are endothermic. The heat required for heating oil shale is very much influenced by the enthalpy of decomposition of the inorganic minerals present. The main minerals that are present in the oil shale are calcite and dolomite, which under suitable condition will undergo endothermic decomposition to other minerals and carbon dioxide. Therefore, it is considered, the occurrence of these endothermic reactions should be avoided by controlling temperature. Calcite decomposition occurs at 600-900° C. (approximately 1100 to 1650° F.) and dolomite decomposition occurs at 600-750° C. (approximately 1100 to 1380° F.). It is therefore considered that oil shale temperature should be kept below about 1100° F. The in situ process described herein will afford good temperature control, with temperatures maintained well below this value by controlling the temperature of the heating fluid exiting the boilers to a level not substantially in excess of 1100° F.

Second Embodiment

The second illustrative embodiment is a scaled up application of the principles described above in connection with the first embodiment. This embodiment describes the extraction of hydrocarbons from a plot of 20 acres, where each well pattern is directed to a 400×2000 foot subterranean body of oil shale to be retorted whose top is located 1000 feet below the surface and contains a 1000 foot thick body of oil shale to be retorted. In this embodiment, energy delivery subsystem 100 comprises a row of approximately 20 cased energy delivery wells 102 approximately 20 feet apart from one another. The cased energy delivery wells are divided between two drill pads at each of the entry and exit ends respectively. Each well 102 is drilled from the site surface 104 down through approximately 1000 feet of overburden 106 and then down through approximately 1000 feet of oil shale zone 108. Each well 102 then extends generally horizontally across the site for about 2000 feet, and then returns up to surface 104. (As before, allowance must be made for the radius of curvature needed to transition from generally vertical orientation to generally horizontal orientation.) As before, wells 102 are part of a substantially closed system through which a fluid heat transfer medium is circulated after being heated.

Hydrocarbon recovery subsystem 200 comprises approximately 32 production/spider wells, disposed throughout the 400×2000 foot pattern to cover the whole plot. Techniques are known for trying to optimize well patterns. See, e.g., de Rouffignac, et al. U.S. Pat. No. 6,712,136, "In situ thermal processing of a hydrocarbon containing formation using a selected production well spacing." and Berchenko, et al., U.S. Pat. No. 6,896,053, "In situ thermal processing of a hydrocarbon containing formation using repeating triangular patterns of heat sources." The boilers and surface processing equipment are centralized where possible and moved as necessary when patterns are completed. Each pattern produces approximately 20,000 to 25,000 barrels of shale oil per day on average over a three year producing period following construction and well drilling.

Concluding Remarks

In this patent, certain U.S. patents and other materials have been incorporated by reference. The text of such U.S. patents and other materials is, however, incorporated by reference only to the extent that no conflict exists between such text and the other statements and drawings directly set forth herein. In the event of any such conflict, then any such conflicting text in such incorporated-by-reference U.S. patents and other materials is specifically not incorporated by reference into this patent.

While the invention has been described in connection with specific and preferred embodiments thereof, it is capable of further modifications without departing from the spirit and scope of the invention. This application is intended to cover all variations, uses, or adaptations of the invention, following, in general, the principles of the invention and including such departures from the present disclosure as come within known or customary practice within the oil well drilling and completion art to which the invention pertains, or as are obvious to persons skilled in that art, at the time the departure is made. It should be appreciated that the scope of this invention is not limited to the detailed description of the invention hereinabove, which is intended merely to be illustrative, but rather comprehends the subject matter defined by the following claims.

As used in the claims, the body of oil shale to be retorted is only a part of the body of oil shale or the oil shale deposit. Generally, the body of oil shale to be retorted is a rectangular column of oil shale that, in the part of Colorado in which the DOE contemplates initial extraction operations, begins approximately 1000 feet below the earth surface. In the first embodiment, it extends downward from that level approximately another 300 feet; it is approximately 100 feet wide and 1000 feet long. The oil shale deposit extends substantially farther in all directions (north, east, south, west, and down) from the body of oil shale to be retorted. The term "body of oil shale" refers to a given or particular portion of an oil shale deposit. The invention contemplates exploitation of many adjacent or nearby bodies of oil shale to be retorted in succession, located within the same oil shale deposit.

As used in the claims, "communicating with" refers to directly or indirectly communicating with. For example, a manifold communicating with a boiler may directly connect to the boiler or may instead connect to a pump that connects to the boiler, so that fluid flows from the manifold directly to the boiler or flows indirectly via the pump.

As used in the claims, a well is drilled "generally vertically" or its orientation is "generally vertical" if the wellbore descends in a vertical path, is aslant, or follows a curved downward path such as the required by the radius of curvature for a transition from a vertical to a horizontal orientation in directional drilling. "Generally downward," "generally horizontal." and similar terminology should be understood similarly.

As used in the claims, references to a pipe or other object being located "beneath" a body of oil shale do not exclude the pipe or other object from being only partly or generally beneath the body of oil shale. For example, the fluid transmission pipe runs generally horizontally beneath the body of oil shale to be retorted, but the pipe also runs beyond the ends of the body of oil shale to be retorted (because of the radius of curvature) and runs in other places as well. In addition, the fluid transmission pipe will retort a small amount of oil shale next to as well as some below the pipe, because some heat is necessarily conducted laterally and downward from the pipe, although most heat is transmitted upward. Similar considerations apply to "above." For example, the surface location of the heating well is above the proximate end of the body of oil shale to be retorted, but may be only generally above it (and not necessarily directly vertical in relation to it), because the well is drilled aslant or is set back to accommodate bend curvature.

The invention claimed is:

1. A process for retorting and extracting hydrocarbons from a subterranean body of oil shale in an oil shale deposit located beneath an overburden, said process comprising the following steps:

(1) Drilling at least one energy delivery well generally downward from an entry end thereof at the earth's surface, said well passing through the overburden, said well extending to the bottom of the body of oil shale to be retorted, at a proximal end of said body;

(2) Continuing said energy delivery well therefrom in a generally horizontal direction through the oil shale deposit across and beneath the body of oil shale to be retorted, to a distal end thereof, and then generally upward therefrom to return through the oil shale deposit and the overburden to an exit end of said energy delivery well, said exit end located at the surface;

(3) Placing at least one fluid transmission pipe within said energy delivery well, said fluid transmission pipe extending uninterruptedly all the way through said energy delivery well, said fluid transmission pipe having an injection end that extends out from said entry end of said energy delivery well, said fluid transmission pipe having a return end that extends out of said exit end of said energy delivery well, said fluid transmission pipe running generally horizontally beneath and across the body of oil shale to be retorted, from said proximal end to said distal end;

(4) Drilling at least one hydrocarbon production well having an upper end located at the surface and having a lower end located at or near the bottom of the overburden;

(5) Drilling at least one spider well, said spider well communicating at an upper end thereof with said hydrocarbon production well, said upper end of said spider well located at or near the bottom of the overburden, said spider well extending generally downward from said upper end thereof to the bottom of the body of oil shale to be retorted, said spider well adapted to transmit retort vapors upward therethrough and to transmit retort liquids downward therethrough, said spider well further adapted to permit retort vapors or liquids to pass between said spider well and the body of oil shale to be retorted;

(6) Drilling a central well downward past said upper end of said spider well to extend said hydrocarbon production well to approximately the bottom of the body of oil shale to be retorted;

(7) Locating a sump below said hydrocarbon production well, said sump adapted for collecting condensed liquid hydrocarbons retorted from the oil shale deposit;

(8) Placing a product gathering pipe within said hydrocarbon production well, said product gathering pipe having a collection end at said upper end of said hydrocarbon production well, said product gathering pipe extending through said hydrocarbon production well down to said sump;

(9) Delivering to said injection end of said fluid transmission pipe a heating fluid heated to at least a retorting temperature, passing said heating fluid through said fluid transmission pipe to said return end thereof, reheating said heating fluid back to at least a retorting temperature, and repeating this step, thereby heating to at least a retorting temperature the body of oil shale above and proximate to said fluid transmission pipe running generally horizontally, thereby causing portions of the body of oil shale to retort, and thereby causing hydrocarbon vapors to ascend through the spider well; and

(10) Extracting retort vapors from said upper end of said spider well and pumping retort liquids out of said product gathering pipe, thereby collecting hydrocarbons retorted from the oil shale.

2. The process of claim 1, wherein said spider well is further adapted to permit hydrocarbon vapors to reflux after ascending through said spider well and to thereby heat the oil shale deposit above the fluid transmission pipe and proximate to said spider well.

3. A process for retorting in situ a subterranean body of oil shale located in an oil shale deposit beneath an overburden, said process comprising:

(1) Placing beneath the subterranean body of oil shale to be retorted, via a cased well extending generally downward through the overburden to approximately the bottom of the subterranean body of oil shale to be retorted and continuing generally horizontally therefrom beneath the subterranean body of oil shale to be retorted, a source of heat energy, said heat energy at a temperature at least a retorting temperature;

(2) Drilling at least one vapor conduit in the subterranean body of oil shale, said conduit extending generally vertically from a portion of the subterranean body of oil shale proximate to said source of heat energy through the subterranean body of oil shale, said vapor conduit adapted to permit an upward movement of vapors from retorted oil shale and a downward movement of liquids condensed from said vapors; said vapor conduit further adapted to permit a movement of said vapors and said liquids between said vapor conduit and the subterranean body of oil shale proximate to said vapor conduit (3) Drilling at least one cased product gathering well through the overburden to approximately the bottom of the body of oil shale to be retorted;

(4) Placing under the cased product gathering well a sump adapted to collect retort liquids so that said retort liquids can be pumped from said sump through said cased product gathering well to the earth surface; and (5) Establishing communication between an upper end of said vapor conduit and said cased product gathering well, so that fluids can flow from said vapor conduit into said cased product gathering well, be transmitted by a pressure differential upward therethrough to the earth surface, and be collected.

4. A process according to claim 3, further comprising packing at least one said vapor conduit at least in part with gravel, said gravel packed to provide hole integrity and permeability to movement of retort vapors and liquids.

5. A process according to claim 3, wherein:

said source of heat energy is a heating fluid contained in a fluid transmission pipe, said heating fluid heated to at least a retorting temperature;

said pipe cases said cased well beneath the subterranean body of oil shale to be retorted; and said pipe is comprised within a closed loop heat delivery module.

6. A process according to claim 3, wherein a plurality of vapor conduits are drilled, said vapor conduits are spider wells having respective lower ends located at the bottom of the body of oil shale to be retorted, and said lower ends are distributed along both sides of said fluid transmission pipe so that said lower ends are approximately equidistant from one another.

* * * * *